US011763711B2

(12) United States Patent
Kim et al.

(10) Patent No.: US 11,763,711 B2
(45) Date of Patent: Sep. 19, 2023

(54) DISPLAY APPARATUS

(71) Applicant: LG Display Co., Ltd., Seoul (KR)

(72) Inventors: Taehwi Kim, Busan (KR); ChungWan Oh, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/550,939

(22) Filed: Dec. 14, 2021

(65) Prior Publication Data

US 2022/0198974 A1 Jun. 23, 2022

(30) Foreign Application Priority Data

Dec. 17, 2020 (KR) ..... 10-2020-0177661

(51) Int. Cl.
*G09G 3/00* (2006.01)
*G09G 3/3266* (2016.01)

(52) U.S. Cl.
CPC ..... *G09G 3/03* (2020.08); *G09G 3/3266* (2013.01); *G09G 2310/061* (2013.01); *G09G 2310/08* (2013.01)

(58) Field of Classification Search
CPC ..... G09G 3/03; G09G 3/3677; G09G 3/3266; G09G 3/3648; G09G 3/3225; G09G 2310/08; G09G 2310/061; G09G 2310/0281; G09G 2310/0278; G09G 2310/0283; G09G 2310/0232; G09G 2310/0286; G09G 2310/0264; G09G 2300/0426; H01L 27/326; H01L 27/3218; H01L 27/3244; G02F 2201/56; G02F 1/13454
See application file for complete search history.

(56) References Cited

U.S. PATENT DOCUMENTS

2016/0113106 A1* 4/2016 Kim ..... H05K 1/028 361/679.01
2017/0219895 A1* 8/2017 Yu ..... G02F 1/13454
2017/0337877 A1* 11/2017 Kim ..... G09G 3/3233
2018/0247582 A1* 8/2018 Park ..... G06F 1/1626
2019/0279575 A1* 9/2019 Kim ..... G09G 3/3266
2019/0304366 A1* 10/2019 Ka ..... H10K 59/123
2021/0048699 A1* 2/2021 Yamada ..... H05K 1/189
2021/0375193 A1* 12/2021 Son ..... G09G 3/3233
2022/0270552 A1* 8/2022 Roh ..... G09G 3/3241

* cited by examiner

*Primary Examiner* — Nitin Patel
*Assistant Examiner* — Amen W Bogale
(74) *Attorney, Agent, or Firm* — Birch, Stewart, Kolasch & Birch, LLP

(57) ABSTRACT

A display apparatus can include a display area including pixel rows, the display area having an outer periphery including a curved section and a straight section; a non-display area surrounding the display area, the non-display area having an outer periphery including a curved section and a straight section; a gate driver disposed in the non-display area, the gate driver including gate blocks corresponding to the pixel rows; and a low potential power line disposed between the gate driver and the outer periphery of the non-display area, in which each of the gate blocks includes a plurality of stages.

20 Claims, 7 Drawing Sheets

DISPLAY APPARATUS

CROSS-REFERENCE TO RELATED APPLICATIONS

This application claims priority to Korean Patent Application No. 10-2020-0177661 filed on Dec. 17, 2020, in the Republic of Korea, the entire contents of which are hereby expressly incorporated by reference into the present application.

BACKGROUND

Field

The present disclosure relates to a display apparatus with a gate driver embedded in a display panel in which a shape of a substrate is not a rectangle, but is a free form.

Description of the Related Art

A wearable device, a flexible device, or a display device for a vehicle requires a free-form display device having various shapes, rather than just a rectangular shaped display device as in the related art. For example, in a clock, a display panel can be a circular plate. Further, depending on a design of the display apparatus, there may be a smart phone in which a corner of a rectangular display panel is formed in a curved line.

A driving circuit of the display panel includes a pixel array in which images are displayed, a data driver which supplies a data signal to data lines of the pixel array, a gate driver which sequentially supplies a gate signal to gate lines of the pixel array, and a timing controller which controls the data driver and the gate driver.

In the related art, the display apparatus is implemented by connecting a separate gate drive IC to a display panel (e.g., spaced apart from the display, at the side). However, according to this method, the cost for the display apparatus is increased due to the cost for ICs and the number of link lines which connect the gate driver and the gate lines is increased, which increases a width of a non-display area.

Recently, a technique which embeds the gate driver in the display panel together with the pixel array is being applied. The gate driver embedded in the display panel is known as a gate in panel (GIP) circuit. The gate in panel circuit includes a shift register. The shift register includes a plurality of stages which are dependently connected. The stages generate an output in response to a start pulse and shifts the output in accordance with a shift clock. The shift register is supplied with a start pulse, a shift clock, and a driving voltage.

When the gate driver is embedded in the display panel, the cost for a drive IC can be reduced, but it is difficult to reduce a size of the non-display area in which the gate driver is disposed. This is because the number of gate stages is increased and the gate driver extends in a horizontal direction in order to ensure an enough space for wiring lines which supply the start pulse, the shift clock, and the driving voltage to the stages of the GIP circuit.

Further, in the situation of a model which is frequently applied in recent years to drive the display apparatus by combining a low temperature poly semiconductor (LTPS) transistor and an oxide semiconductor transistor, more gate stages than that of the normal display apparatus are necessary. For example, when hetero-thin film transistors are applied, a plurality of gate stages can be further needed to drive a low temperature poly semiconductor LTPS transistor which is a P-type thin film transistor and an oxide semiconductor transistor which is an N-type thin film transistor together. A circuit which generates a scan signal for the oxide semiconductor transistor and a circuit which generates a reset signal of an oxide semiconductor transistor may be separately needed. Further, there can be a GIP circuit which turns on and off a reset signal of the oxide semiconductor transistor.

There is a trend that the display panel uses hetero-transistors to have higher performance and users prefer a display having a large display screen in which a bezel ratio of a non-display area is smaller than a screen of a display area or a free-form display apparatus with various shapes. Therefore, the gate stages of the gate driver are increased so that a size of the non-display area ends up being increased as well, which can lead to issues and constraints.

In order to address the above-described limitations, in recent years, various methods for reducing a non-display area of a free-form display panel with an embedded gate driver are sought.

SUMMARY OF THE DISCLOSURE

As mentioned above, when the gate driver is embedded in the display panel, the gate driver occupies a part of the non-display area so that a size of the non-display area can be increased. In order to reduce the size of the non-display area of the display panel in which hetero-transistors are applied, a layout of the gate driver can be optimized to reduce an area occupied by the gate driver or a gate driver is disposed to be deformed in a remaining space of a free-form portion to reduce the space of the non-display area.

Therefore, in the present disclosure, a method for optimizing a design of the gate driver will be described.

In the gate driver, gate blocks formed by a plurality of stages are connected to correspond to the pixel array. The free-form display panel includes a curved line so that the gate driver embedded in the free-form portion of the display panel can be disposed along the curved line. However, a plurality of stages which configure the blocks are disposed in a rectangular space so that it is difficult to dispose the gate driver in a curved portion of the free-form non-display area. Accordingly, the gate driver disposed in the free-form non-display area can be irregularly disposed more than a gate driver disposed in a non-display area having a rectangular or straight bezel and a size of the non-display area is increased.

Therefore, the inventors of the present disclosure recognized the above-mentioned problems and limitations associated with the related art and thus have invented a structure of a link line in which a size of a non-display area was reduced in a free-form portion and a display panel using the same.

An object to be achieved by the present disclosure is to provide a gate driver structure which is capable of reducing a size of a non-display area in a free-form portion and a display panel using the same.

Objects of the present disclosure are not limited to the above-mentioned objects, and other objects, which are not mentioned above, can be clearly understood by those skilled in the art from the following descriptions.

According to an aspect of the present disclosure, a display apparatus includes a display area which is formed of pixel rows and has an outer periphery with a curved section and a straight section; a non-display area which encloses the display area and has an outer periphery with a curved section and a straight section; a gate driver which is configured by gate blocks corresponding to the pixel rows and is disposed in the non-display area, the gate block including a plurality of stages and a lower potential power line disposed between the gate driver and the outer periphery of the non-display area.

According to another aspect of the present disclosure, a display apparatus includes a display area which is formed of pixel rows and has an outer periphery with a curved section and a straight section; a non-display area which encloses the display area and has an outer periphery with a curved section and a straight section; and a gate driver which is configured by gate blocks corresponding to the pixel rows and is disposed in the non-display area, in which the gate block includes a plurality of stages and the plurality of stages include a first scan driving circuit, a second scan driving circuit, an emission driving circuit, a switching driving circuit, and a reset driving circuit.

Other detailed matters of the example embodiments are included in the detailed description and the drawings.

According to the example embodiments of the present disclosure, the placement of a gate driver including an increased number of gate stages by applying hetero-thin film transistors is optimized to minimize a space of a free-form non-display area.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
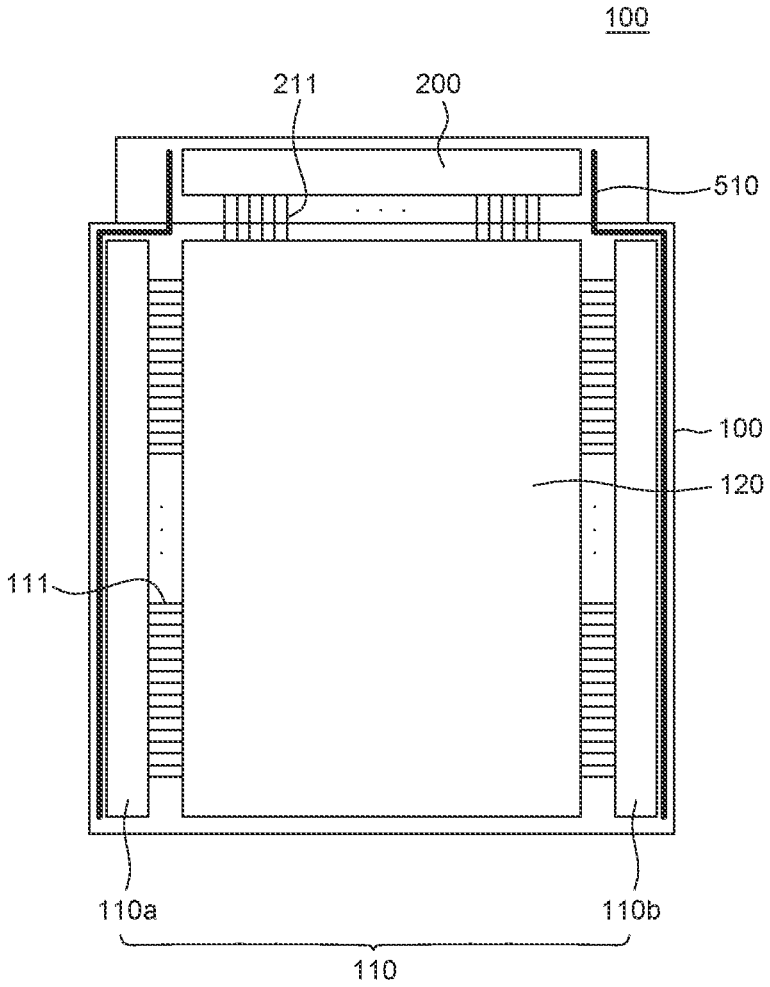
FIG. 1 is a plan view illustrating a display panel according to an embodiment of the present disclosure.

Advantages and characteristics of the present disclosure and a method of achieving the advantages and characteristics will be clear by referring to example embodiments described below in detail together with the accompanying drawings. However, the present disclosure is not limited to the example embodiments disclosed herein but will be implemented in various forms. The example embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the example embodiments of the present disclosure are merely examples, and the present disclosure is not limited thereto. Like reference numerals generally denote like elements throughout the specification. Further, in the following description of the present disclosure, a detailed explanation of known related technologies can be omitted to avoid unnecessarily obscuring the subject matter of the present disclosure. The terms such as "including," "having," and "comprising" used herein are generally intended to allow other components to be added unless the terms are used with the term "only." Any references to singular can include plural unless expressly stated otherwise.

Components are interpreted to include an ordinary error range even if not expressly stated.

When the position relation between two parts is described using the terms such as "on," "over," "above," "below," and "next," one or more parts can be positioned between the two parts unless the terms are used with the term "immediately" or "directly."

When an element or layer is disposed "on" another element or layer, it can be disposed directly on the another element or layer, or another layer or another element can be interposed therebetween.

Although the terms "first," "second," and the like are used for describing various components, these components are not confined by these terms. These terms are merely used for distinguishing one component from the other components. Therefore, a first component to be mentioned below can be a second component in a technical concept of the present disclosure.

In describing components of the example embodiments of the present disclosure, terminologies such as first, second, A, B, (a), (b), and the like can be used. The term is used to distinguish a component from the other component but a nature, an order, or the number of the components is not limited by the terminology. If it is described that a component is "connected" or "coupled" to another component, it is understood that the component can be directly connected or coupled to the other component but another component can be "connected" or "coupled" between the components.

In the present specification, a "display apparatus" can include a display apparatus which includes a display panel and a driver for driving the display panel, in a narrow sense, such as a liquid crystal module (LCM), an organic light emitting diode module (OLED module), and a quantum dot (QD) module. Further, the "display apparatus" can further include a set electronic device or a set device (or a set apparatus) which is a complete product or a final product including an LCM, an OLED module, or a QD module, such as a notebook computer, a television, or a computer monitor, an automotive display or equipment display including another type of vehicle and a mobile electronic device including a smart phone or an electronic pad.

Accordingly, the display apparatus of the present disclosure can include not only a display apparatus itself in a narrow sense such as an LCM, an OLED module, or a QD module, but also an applied product or a set apparatus which is a final consumer device including the LCM, the OLED module, or the QD module.

Further, if necessary, the LCM, the OLED module, or the QD module which is configured by a display panel and a driver is represented as a display apparatus in a narrow sense and an electronic device as a complete product including the LCM, the OLED module, and the QD module can be represented as a "set apparatus." For example, the display apparatus in the narrow sense includes a liquid crystal display (LCD) panel, an OLED display panel, or a quantum dot display panel and a source PCB which is a controller for driving the display panel. In contrast, the set device can be a concept further including a set PCB which is a set controller which is electrically connected to the source PCB to control the entire set device.

A display panel used in the present example embodiment can use any type of display panel, such as a liquid crystal display panel, an organic light emitting diode (OLED) display panel, a quantum dot (QD) display panel, and an electroluminescent display panel. But the display panel is not limited to a specific display panel which is capable of bending a bezel, with a flexible substrate for the OLED display panel of the present disclosure and a lower backplate support structure. Further, the display panel used for the display apparatus according to the example embodiments of the present disclosure is not limited to a shape or a size of the display panel.

For example, when the display panel is an OLED display panel, the display panel includes a plurality of gate lines and a plurality of data lines, and pixels formed at the intersections of the gate lines and the data lines. Further, the display panel can be configured to include an array including a thin film transistor which is an element to selectively apply a voltage to each pixel, an organic light emitting diode (OLED) layer on the array, and an encapsulation substrate or an encapsulation layer disposed on the array to cover the organic light emitting diode layer. The encapsulation layer protects the thin film transistor and the organic light emitting diode layer from external impacts and suppresses the permeation of moisture or oxygen into the organic light emitting diode layer. Further, a layer formed on the array can include an inorganic light emitting layer, for example, a nano-sized material layer or quantum dot layer.

FIG. 1 illustrates an example organic light emitting diode (OLED) display panel 100 which can be integrated in the display apparatuses.

FIG. 1 illustrates an example display apparatus which can be included in an electronic apparatus. Particularly, FIG. 1 is a view illustrating a display panel according to an example embodiment of the present disclosure.

Referring to FIG. 1, the display panel 100 can be divided into a pixel area 120 and an area other than the pixel area 120. The pixel area 120 is an area which includes a pixel array formed of pixel rows and displays a screen and is also referred to as a display area. An area other than the pixel area 120 is a non-display area and can include a gate driver 110, various wiring lines, and pad units which apply signals to the pixels. Even though in FIG. 1, the data driver 200 is disposed outside of the display panel 100, the position of the data driver 200 is not limited thereto.

The data driver 200 outputs a data signal in response to a data timing control signal supplied from a timing controller. The data driver 200 samples and latches a digital data signal supplied from the timing controller to convert the digital data signal into an analog data signal based on a gamma reference voltage. The output data signal is provided to a data line in the pixel area 120 via a data link line 211. Specifically, the data driver 200 can be formed on the display panel 100 in the form of an integrated circuit (IC) or formed on the display panel 100 in the form of a chip on film. Further, depending on a product, the timing controller is combined with the data driver 200 to be implemented as a single chip.

The gate driver 110 outputs a gate signal in response to a gate timing control signal supplied from the timing controller. The gate timing control signal, for example, includes gate clock signals GCLK1_L, GCLK2_L, GCLK1_R, and GCLK2_R and a start signal. The gate driver 110 supplies a gate signal to the gate line in the pixel area 120 via a gate link line 111. The gate driver 110 can be formed in the form of an integrated circuit (IC), but in the present disclosure, can be formed to be embedded in the display panel in the form of a gate in panel GIP. The gate driver 110 can be disposed at a left side and a right side of the display panel 100 or can be disposed at any one side.

A low potential power line 510 is disposed at the outside of the gate driver 110 of the display panel 100. For example, the low potential power line 510 can be disposed between the gate driver 110 and the outer periphery of the non-display area. The low potential power line 510 can supply a ground power of the organic light emitting diodes of the pixel area 120.

As mentioned above, the display panel 100 displays images in response to the gate signal and the data signal supplied from the gate driver 110 and the data driver 200 and a power voltage supplied from a power supply unit.

Figure 2:
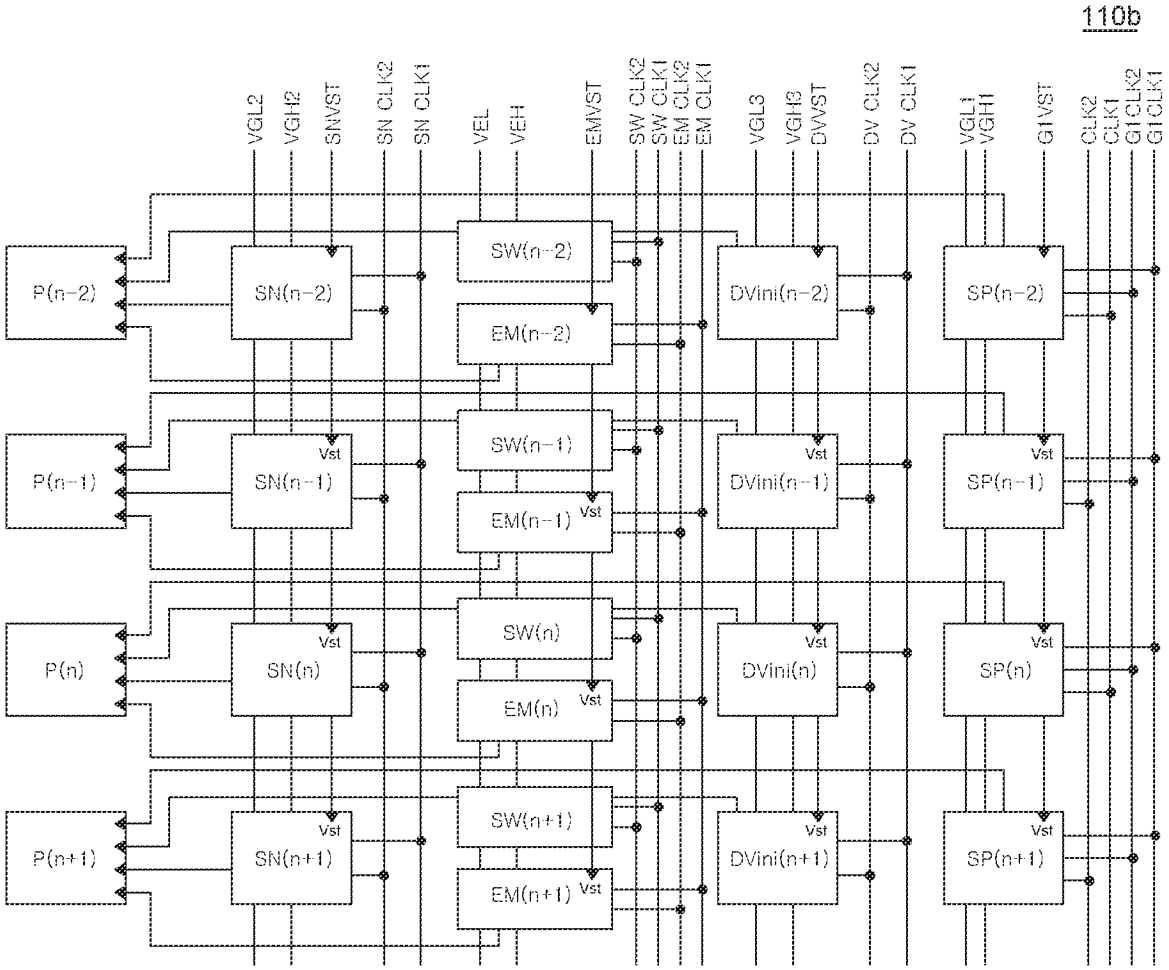
FIG. 2 is a block diagram illustrating a gate driving circuit when hetero-transistors are applied in FIG. 1 according to an embodiment of the present disclosure.

FIG. 2 is a block diagram illustrating a gate driving circuit (the second gate driver) 110*b* when hetero-transistors are applied in FIG. 1. In FIG. 2, a gate signal applied to a pixel circuit of FIG. 1 is supplied.

Referring to FIG. 2, the gate driver 110 includes a first scan driving circuit SP, a switch driving circuit SW, an emission driving circuit EM, a second scan driving circuit SN, and a reset driving circuit DVini. The first scan driving circuit SP, the switch driving circuit SW, the emission driving circuit EM, the second scan driving circuit SN, and the reset driving circuit Dvini are a plurality of stages including shift registers and the circuits are gathered to form a block or gate block. In FIG. 2, a (n−2)-th stage, a (n−1)-th stage, a n-th stage, and a (n+1)-th stage among the plurality of stages are illustrated as an example, where n is a natural number greater than or equal to 2.

The first scan driving circuit SP includes first scan stages SP(n−2) to SP(n+1) and wiring lines. The wiring lines are applied with a first-first gate clock signal G1CLK1, a first-second gate clock signal G1CLK2, a first clock signal CLK1, a second clock signal CLK2, a first gate low voltage VGL1, a first gate high voltage VGH1, and a first gate start voltage G1VST input to the first scan stages. The first scan stages output signals while shifting the first gate start voltage G1VST in accordance with the first-first gate clock signal G1CLK1 and the first-second gate clock signal G1CLK2. Each stage outputs two output signals. For example, a n-th first scan stage SP(n) outputs a first output signal which is input as a start signal Vst of the (n+1)-th first scan stage SP(n+1) and a second output signal which is input to a gate line of a n-th pixel row P(n). Specifically, the second output signal of the n-th first scan stage SP(n) can correspond to the first scan signal of the n-th pixel row P(n).

The first scan driving circuit SP can input the scan signal to the gate line to drive a low temperature poly semiconductor (LTPS) transistor of the pixel circuit.

The second scan driving circuit SN includes second scan stages SN(n−2) to SN(n+1) and wiring lines. The wiring lines are applied with a second-first gate clock signal SNCLK1, a second-second gate clock signal SNCLK2, a second gate low voltage VGL2, a second gate high voltage VGH2, and a second gate start voltage SNVST input to the second scan stages.

The second scan stages output two output signals while shifting the second gate start voltage SNVST in accordance with the second-first gate clock signal SNCLK1 and the second-second gate clock signal SNCLK2. For example, an output signal of a n-th second scan stage SN(n) is input as a start signal Vst of the (n+1)-th second scan stage SN(n+1) and the other output signal of a n-th second scan stage SN(n) is input to the gate line of the n-th pixel row P(n). Specifically, the other output signal of the n-th second scan stage SN(n) can correspond to the second scan signal of the n-th pixel row P(n).

The second scan driving circuit SN can input the scan signal to the gate line to drive an oxide semiconductor transistor of the pixel circuit.

The second scan signal is input to a gate electrode of an n-type transistor and the first scan signal is input to a gate electrode of a p-type transistor. The gate-on voltage VGH of the n-type transistor is an inverted voltage of the gate-on voltage of the p-type transistor. That is, the second scan signal can be implemented by inverting the first scan signal. Accordingly, the first scan stages can be implemented by inverting output signals of the second scan stages. In this situation, a first output signal of the first scan stages can be the same as the output signal of the second scan stages so that the first scan stages can be formed using a circuit which configures the second scan stages. Further, the first scan stages can generate an output signal obtained by inverting a signal output from the second scan stages by additionally using the first clock signal CLK1 and the second clock signal CLK2.

The emission driving circuit EM includes emission stages EM(n−2) to EM(n+1) and wiring lines. The wiring lines are applied with a first emission clock signal EMCLK1, a second emission clock signal EMCLK2, an emission low voltage VEL, an emission high voltage VEH, and an emission start voltage EMVST input to the emission stages. The emission stages output two output signals while shifting the emission start voltage EMVST in accordance with the first emission clock signal EMCLK1 and the second emission clock signal EMCLK2. For example, a first output signal of a n-th emission stage EM(n) is input as a start signal Vst of a (n+1)-th emission stage EM(n+1) and a second output signal is input to the gate line of the n-th pixel row P(n). Specifically, the output signal of the n-th emission stage EM(n) can correspond to the emission signal of the n-th pixel row P(n).

The reset driving circuit DVini includes reset stages DVini(n−2) to DVini(n+1) and wiring lines. The wiring lines are applied with a first reset clock signal DVCLK1, a second reset clock signal DVCLK2, a reset low voltage VGL3, a reset high voltage VGH3, and a reset start voltage DVVST input to the reset stages. The reset stages output two output signals while shifting the reset start voltage DVVST in accordance with the first reset clock signal DVCLK1 and the second reset clock signal DVCLK2. For example, a first output signal of a n-th reset stage DVini(n) is input as a start signal Vst of a (n+1)-th reset stage DVini(n+1) and a second output signal is input to the gate line of the n-th pixel row P(n). Specifically, the output signal of the n-th reset stage DVini(n) can correspond to the reset signal of the n-th pixel row P(n). When the reset signal is driven from the high speed driving (120 Hz to 60 Hz) to a low speed (1 Hz) for low power consumption, as compared with the other display apparatus, screen flickering or the screen switching speed can be relatively slowly recognized. In order to solve this problem, a high AC voltage and a low AC voltage can be applied to the driving transistor, rather than a DC voltage. In order to apply the AC voltage to the driving transistor, the reset driving circuit DVini can be applied.

The switch driving circuit SW can serve as a switch which controls whether to input the reset signal of the reset driving circuit DVini to the driving transistor.

Figure 3:
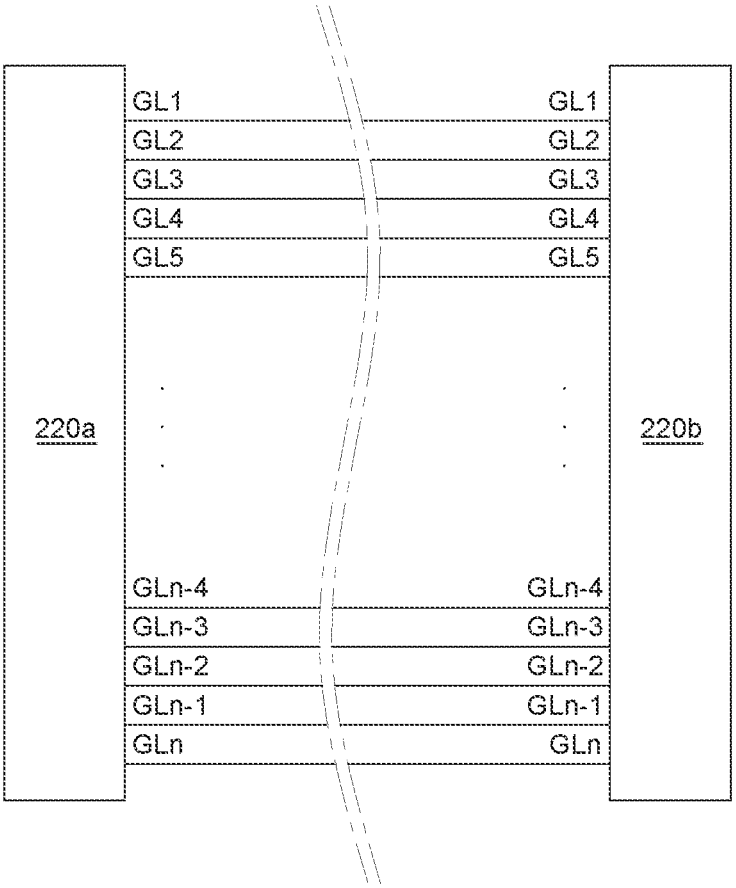
FIG. 3 is a view illustrating a connection pattern of a gate driver and a gate line according to an embodiment of the present disclosure.
Figure 4:
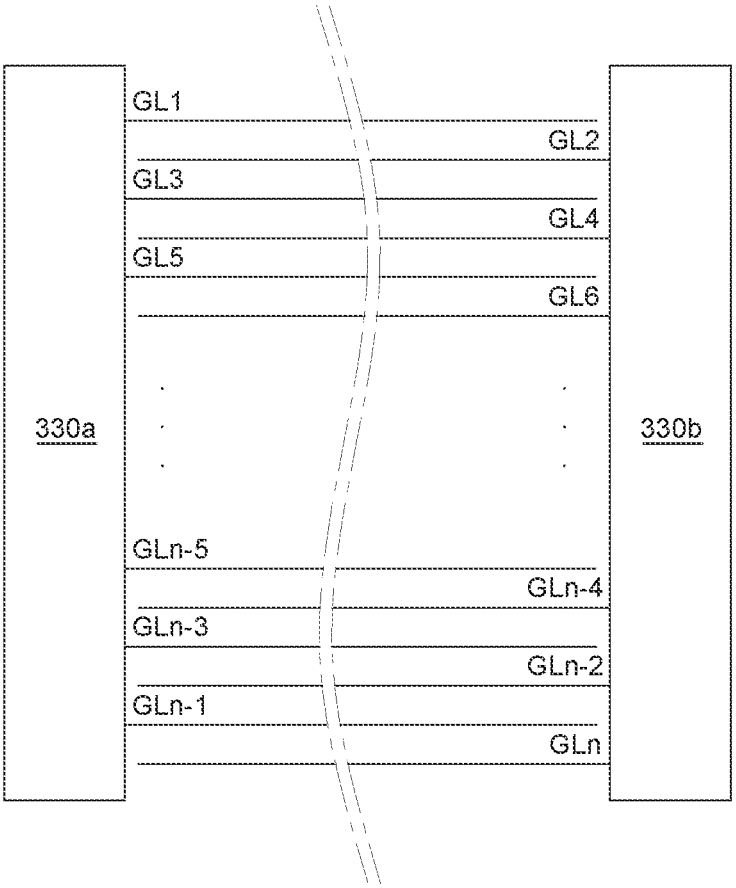
FIG. 4 is a view illustrating another connection pattern of a gate driver and a gate line according to an embodiment of the present disclosure.

FIGS. 3 and 4 are views illustrating various connection patterns of a gate driver and a gate line.

Referring to FIG. 3, the gate driver includes a first gate driver 220*a* disposed at one edge (e.g., a left side) of the display panel 100 and a second gate driver 220*b* disposed at the other edge (e.g., a right side). The first gate driver 220*a* and the second gate driver 220*b* are connected to the gate lines GL1 to GLn connected to all pixel rows disposed in the pixel area 120.

The first gate driver 220*a* and the second gate driver 220*b* are simultaneously applied with the start signal Vst to simultaneously output the gate signal. Accordingly, the gate signals output from the first gate driver 220*a* and the second gate driver 220*b* are simultaneously applied to both ends of the same gate line. For example, when the pixels of the pixel area 120 are divided by half into the left half and the right half, the first gate driver 220*a* applies the gate signal to the pixels in the left half and the second gate driver 220*b* applies the gate signal to the pixels in the right half. By doing this, the gate signal is quickly applied to the pixels of the high resolution display panel to drive the pixels.

Referring to FIG. 4, a first gate driver 330*a* is connected to a first group of gate lines to sequentially supply the gate signal to the first group of gate lines. A second gate driver 330*b* is connected to a second group of gate lines to sequentially supply the gate line to the second group of gate lines.

The first group of gate lines can be odd-numbered gate lines (GL1, GL3, to GLn−1). The second group of gate lines can be even-numbered gate lines (GL2, GL4, to GLn). In this situation, the start signal Vst can be applied to the first gate driver 330*a* and the second gate driver 330*b* with a predetermined time difference. Accordingly, there can be a predetermined time difference in a gate signal output timing and a carry signal output timing of the first gate driver 330*a* and the second gate driver 330*b*. For example, after the first gate signal is applied from the first gate driver 330*a* to the first gate line GL1, the second gate signal can be supplied from the second gate driver 330*b* to the second gate line GL2 approximately one horizontal period later. According to the design structure of the first gate driver 330*a* and the second gate driver 330*b* which are disposed at the left side and the right side of the display panel, a margin is ensured in the arrangement space so that the layout of the gate driver can be changed in various forms.

Figure 5:
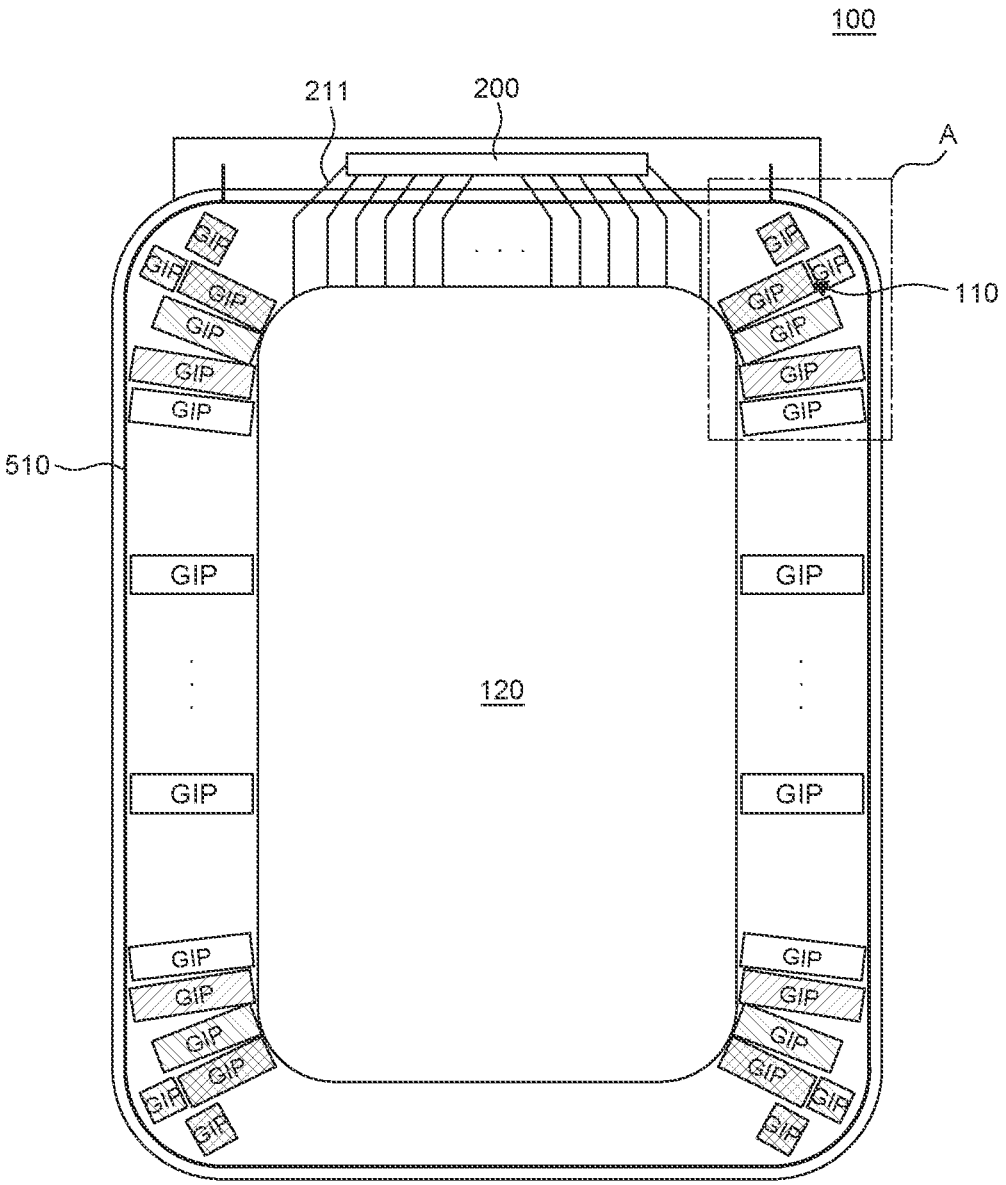
FIG. 5 is a plan view in which a gate driver is disposed on a display panel according to an embodiment of the present disclosure.

FIG. 5 is a plan view in which a gate driver according to an example embodiment is disposed on or in a display panel 100.

Referring to FIG. 5, the data driver 200 can be disposed on an upper plane of the display panel 100 and transmit a data signal to the pixel area 120 via the data link line 211. A first gate driver 110*a* and a second gate driver 110*b* (see FIG. 1) can be disposed at a left side and a right side of the non-display area which encloses the pixel area 120. As shown in FIG. 5, the display area can be formed of pixel rows and have an outer periphery with a curved section and a straight section, and the non-display area can enclose the display area and have an outer periphery with a curved section and a straight section (e.g., the display area can have a rectangular shape with rounded corners, which can be surrounded by a non-display area having a larger rectangular shape with rounded corners). Further, gate blocks corresponding to the straight section of the outer periphery of the display area can be disposed in a straight line, and gate blocks corresponding to the curved section of the outer periphery of the display area can be atypical (e.g. disposed in a staggered type of arrangement or an arrangement that is non-uniform).

As described in FIG. 2, the display panel 100 using hetero-transistors, such as a low temperature poly semiconductor (LTPS) transistor and an oxide semiconductor transistor can have a stage of the gate driver 110 which is complex, to drive transistors having different characteristics. As the structure of the gate driver become more complicated, then the area occupied by the gate driver becomes larger, e.g., as described in FIG. 2, a gate driver having five stages for every pixel row can be disposed. However, it may be difficult to dispose the gate driver at the corner of the display panel 100 due to space constraints.

In the corner of the pixel area 120, a curved area has the smallest radius of curvature to ensure the pixel area as wide as possible. In contrast, in order to minimize the non-display area, in the corner of the display panel 100, the radius of curvature of the curved area of the corner needs to be formed to be larger than the radius of curvature of the pixel area 120. The non-display area in the corner can be relatively narrow. The non-display area of the corner of the display panel 100 is narrower than the other display area so that it may be rather restrictive with regards to the placement of the gate driver 110.

Similar to FIG. 1, not only the gate driver 110, but also the low potential power line 510 needs to be disposed in the non-display area of the display panel 100. Therefore, the non-display area of the corner of the display panel 100 can be a narrower space so that in order to install the gate driver 110, the pixel area 120 needs to be reduced. In the non-display areas of four corners of the display panel 100, there can be a problem of a lack of space as described above. The gate drivers 110 are disposed at the left and right sides of the pixel area 120 to correspond to the pixels one to one and to this end, the gate drivers 110 can be disposed, as illustrated in FIG. 2, such that five stages are disposed in one line. In the non-display areas of the corners of the display panel 100, stages of the gate drivers 110 can be separately disposed.

Figure 6:
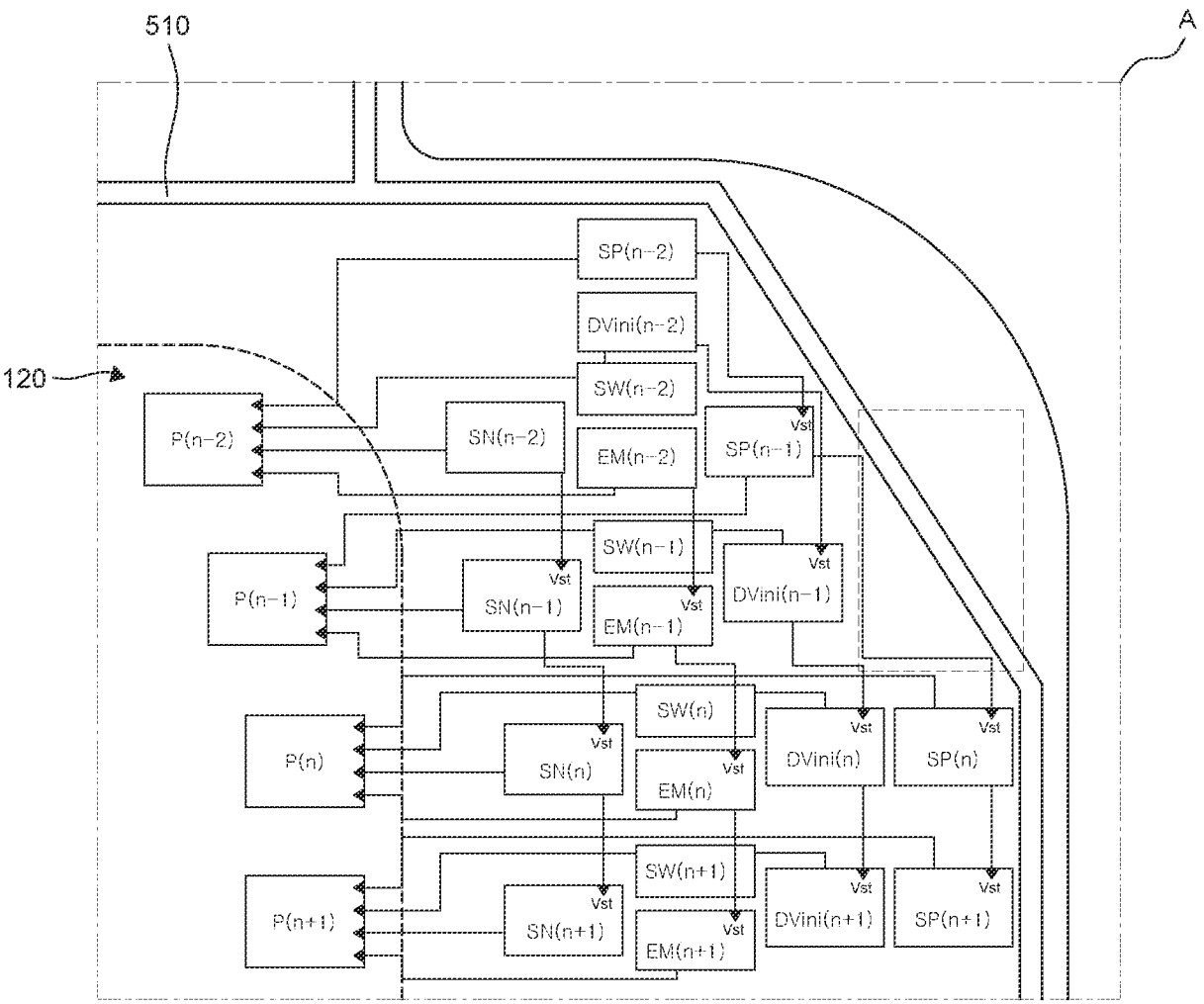
FIG. 6 is a plan view illustrating a region A related to a gate driver disposed in a non-display area of a corner of a display panel of FIG. 5 according to an embodiment of the present disclosure.

FIG. 6 is a plan view illustrating a region A related to a gate driver 110 disposed in a non-display area of a corner of a display panel 100 of FIG. 5.

Referring to FIG. 6, an outer periphery of the pixel area 120 is represented with a dotted line, and an outer periphery of the display panel 100 is represented with a solid line. Pixels are disposed in the pixel area 120 and the gate drivers 110 and the low potential power line 510 are disposed in the non-display area between the outer periphery of the pixel area 120 and the outer periphery of the display panel 100. Similar to FIG. 2, the gate drivers 110 include a plurality of stages, such as a first scan driving circuit SP, a second scan driving circuit SN, an emission driving circuit EM, a reset driving circuit DVini, and a switch driving circuit SW. In the situation of a n−2-th pixel row P(n−2) and a n−1-th pixel row P(n−1) of the pixel area adjacent to the corner of the display panel 100, a space for disposing all the stages of the gate driver 110 can be insufficient in the non-display area.

Referring to FIG. 6, the low potential power line 510 is disposed at the outer periphery of the gate driver 110 to enclose the pixel area 120. At this time, due to the characteristic of the low potential power line 510, the low potential power line 510 may be sensitive to a voltage drop by a resistance, which is a reason to dispose the low potential power line 510 in a short range away for a screen quality of the organic light emitting diode disposed in the pixel area 120. The low potential power line 510 is disposed in a straight line as much as possible, in order to minimize a distance for providing low resistance and is also disposed at the corner of the display panel 100 in the same manner. If the placement of the low potential power line 510 and the placement of the gate driver 110 are connected according to the shape of the gate driver of the related art, stages of the gate driver 110 corresponding to the n−2-th pixel row P(n−2) and the n−1-th pixel row P(n−1) and the low potential power line 510 may interfere with each other at the outer corner of the display panel 100.

Even though in FIG. 6, only a right upper side corner is illustrated, the same problem may also be caused at a left upper side corner, a right lower side corner, and a left lower side corner.

In order to avoid interference issue between the gate driver 110 and the low potential power line 510, the inventors considered separately disposing the stages of the gate driver 110. For example, the reset driving circuit DVini and the first scan driving circuit SP can be disposed not in a standardized linear arrangement of the related art, but the gate block can be disposed in an atypical arrangement, such as in an "]" shape, or a "⌊" shaped arrangement, rather than in a linear type of arrangement.

Referring to FIG. 6, in the situation of the gate driver 110 corresponding to the n−2-th pixel row P(n−2), the second scan driving circuit SN(n−2), the emission driving circuit EM(n−2), and the switching driving circuit SW(n−2) are disposed. Further, the reset driving circuit DVini(n−2) which was disposed at a side of the emission driving circuit EM(n−2) and the switching driving circuit SW(n−2) can be disposed above the switching driving circuit SW(n−2). When the first scan driving circuit SP(n−2) is disposed above the reset driving circuit DVini(n−2), the placement of the reset driving circuit DVini(n−2) and the first scan driving circuit SP(n−2) corresponding to the n−2-th pixel row P(n−2) is changed. Therefore, an empty space can be ensured at the side of the emission driving circuit EM(n−2) and the switching driving circuit SW(n−2). Further, there is an empty space above the switching driving circuit SW(n−2), so that the reset driving circuit DVini(n−2) and the first scan driving circuit SP(n−2) can be disposed in this empty space.

Next, in the gate driver 110 corresponding to the n−1-th pixel row P(n−1), the second scan driving circuit SN(n−1), the emission driving circuit EM(n−1), and the reset driving circuit DVini(n−1) are disposed in the order closer to the pixel row P(n−1). In the situation of a gate driver corresponding to the n−1-th pixel row P(n−1), the first scan driving circuit SP(n−1) can be disposed above the reset driving circuit DVini(n−1) and thus, the area at the side of the reset driving circuit DVini(n−1) can be an empty space. The first scan driving circuit SP(n−1) corresponding to the n−1-th pixel row P(n−1) can be disposed at the side of the emission driving circuit EM(n−2) and the switching driving circuit SW(n−2) corresponding to the n−2-th pixel row P(n−2). By moving a position of the first scan driving circuit SP(n−2) and the reset driving circuit DVini(n−2) corresponding to the n−2-th pixel row P(n−2), an adequate space for disposing the first scan driving circuit SP(n−1) corresponding to the n−1-th pixel row P(n−1) is prepared.

In the gate driver 110 corresponding to the n-th pixel row P(n) and the n+1-th pixel row P(n+1), as the same as the placement of FIG. 2, the second scan driving circuit SN, the emission driving circuit EM, the switch driving circuit SW, the reset driving circuit DVini, and the first scan driving circuit SP are disposed in the order closer to each pixel row. For example, some of the gate driver components for the top two rows of pixels can be pulled and shifted in a direction up and to the left, as shown in FIG. 6, to save space and also allow for the low potential power line 510 to be placed closer to the display area in the rounded corner portion by being allowed to follow a diagonal path or bend, rather than having to use a 90 degree turn.

In addition, the stages of the gate driver 110 can be disposed with various structures, but there can be a positional reference which should be kept. The reset driving circuit DVini and the switching driving circuit SW can be disposed such that the switching driving circuit SW is closer to the pixel row P than the reset driving circuit DVini or the output line passes through the switching driving circuit. Even though it has been described in FIG. 2, the switching driving circuit SW determines whether to input a driving transistor reset signal of the reset driving circuit DVini so that the output signal of the reset driving circuit DVini can be necessarily connected to the pixel row P via the switching driving circuit SW.

Referring to FIG. 6, the positions of the first scan driving circuit SP(n−2) and the reset driving circuit DVini(n−2) corresponding to the n−2-th pixel row P(n−2) are moved and the position of the first scan driving circuit SP(n−1) corresponding to the n−1-th pixel row P(n−1) is moved (e.g., these components are shifted up and to the left, as shown in FIG. 6). Therefore, an empty space can be ensured at the corner of the display panel 100 corresponding to the n−2-th pixel row P(n−2) and the n−1-th pixel row P(n−1). The low potential power line 510 can be disposed in the ensured empty space with a shortest distance which does not overlap the gate driver 110 (e.g., the low potential power line 510 is allowed to follow a shorter diagonal path across the rounded corner area to minimize the distance and avoid an increase in resistance, rather than having to follow a 90 degree bend around the corner area).

A length of the gate block corresponding to the n−2-th pixel row P(n−2) can be approximately half a length of a gate block corresponding to the n+1-th pixel row P(n+1). The length of the gate block can be considered as a length extending from an outer periphery of the pixel area 120 to an outer periphery of the non-display area. The straight gate block can have a first length extending from an outer periphery of the straight section of the display area to the outer periphery of the non-display area and the atypical gate block can have a second length extending from an outer periphery of the curved section of the display area to the outer periphery of the non-display area. The first length can be larger than the second length.

Referring to FIG. 6, the low potential power line 510 extends in a horizontal direction and then turns in the vicinity of the first scan driving circuit SP(n−2) corresponding to the n−2-th pixel row P(n−2) to extend to form a diagonal line closest to the gate drivers 110 (e.g., the low potential power line 510 can have two bends in the rounded corner area, each forming an obtuse angle, rather than having one 90 degree angle bend). The low potential power line 510 extends at a corner area of the display panel 100 in a diagonal direction to extend to a right lower corner of the display panel 100 in the vicinity of the first scan driving circuit SP(n) corresponding to the n-th pixel row P(n) in the vertical direction.

Figure 7:
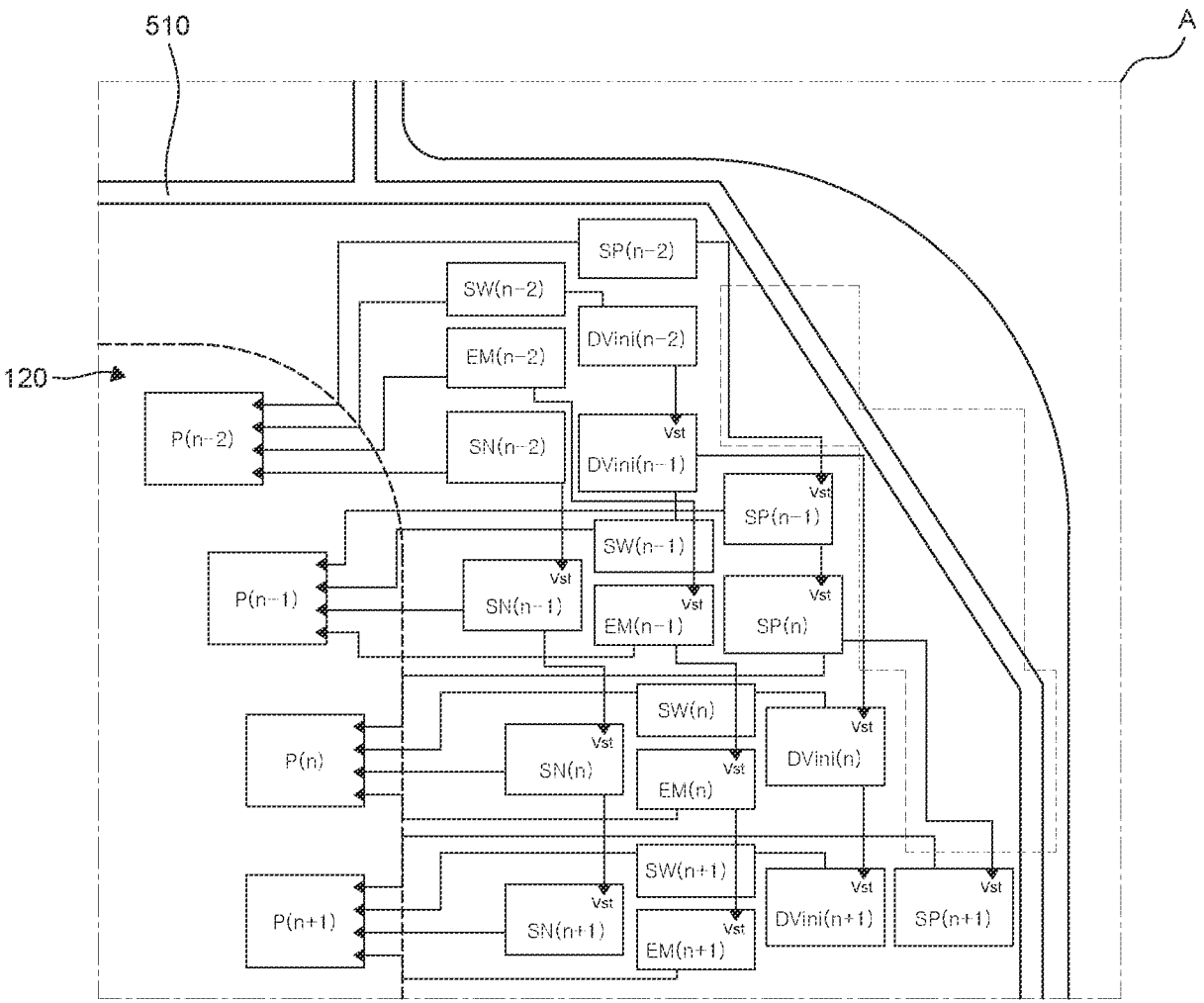
FIG. 7 is a plan view illustrating another example of a region A related to a gate driver disposed in a non-display area of a corner of a display panel of FIG. 5 according to an embodiment of the present disclosure.

FIG. 7 is a plan view illustrating another example of a region A related to a gate driver 110 disposed in a non-display area of a corner of a display panel 100 of FIG. 5.

Referring to FIG. 7, similar to FIG. 6, an outer periphery of the pixel area 120 is represented with a dotted line and an outer periphery of the display panel 100 is represented with a solid line. Pixels are disposed in the pixel area 120 and the gate drivers 110 and the low potential power line 510 are disposed in the non-display area between the outer periphery of the pixel area 120 and the outer periphery of the display panel 100. The gate drivers 110 include stages, such as a first scan driving circuit SP, a second scan driving circuit SN, an emission driving circuit EM, a rest driving circuit DVini, and a switch driving circuit SW. In the situation of a n−2-th pixel row P(n−2) and a n−1-th pixel row P(n−1) of the pixel area 120 adjacent to the corner of the display panel 100, a space for disposing all the stages of the gate driver 110 may be insufficient in the non-display area. For example, in FIG. 7, components of the gate driver for the top three rows of pixels can be shifted up and to the left, in order to better save space in the rounded corner area, and allow the low potential power line 510 to be placed closer to the display area.

Referring to FIG. 7, the low potential power line 510 is disposed at the outer periphery of the gate driver 110 to enclose the pixel area 120. At this time, due to the characteristic of the low potential power line 510, the low potential power line 510 may be sensitive to voltage drop by a resistance, which is a reason to dispose the low potential power line 510 in a short range for a screen quality of the organic light emitting diode disposed in the pixel area 120 (e.g., to place the low potential power line 510 as close to the display area as possible). The low potential power line 510 is disposed in a straight line as much as possible to minimize a distance for low resistance and is also disposed at the corner of the display panel 100 in the same manner. If the placement of the low potential power line 510 and the placement of the gate driver 110 are connected according to the shape of the gate driver of the related art, stages of the gate driver 110 corresponding to the n−2-th pixel row P(n−2) and the n−1-th pixel row P(n−1) and the low potential power line 510 can interfere with each other at the outer corner of the display panel 100 (e.g., the placement of the low potential power line 510 in the related art may overlap or come very close to components of the gate driver in the corner, which may cause undesirable interference).

Even though in FIG. 7, only a right upper side corner is illustrated, the same issue can also be caused at a left upper side corner, a right lower side corner, and a left lower side corner.

In order to avoid the interference of the gate driver 110 and the low potential power line 510, the inventors considered separately disposing the stages of the gate driver 110. For example, the reset driving circuit DVini and the first scan driving circuit SP can be disposed not in a standardized linear arrangement of the related art, but the gate block can be disposed in an atypical arrangement, such as "⌋" type of arrangement shape, "⌊" type of arrangement shape, or "⊢" type of arrangement shape, rather than a linear type.

Referring to FIG. 7, in the situation of the gate driver 110 corresponding to the n−2-th pixel row P(n−2), the emission driving circuit EM(n−2) and the switching driving circuit SW(n−2) are disposed above the second scan driving circuit SN(n−2). Further, the reset driving circuit DVini(n−2) and the first scan driving circuit SP(n−2) are disposed at a side of the emission driving circuit EM(n−2) and the switching driving circuit SW(n−2). The first scan driving circuit SP(n−2) is disposed on an upper side of the reset driving circuit DVini(n−2) to dispose the stages corresponding to the pixel row P(n−2) in an upper area where the gate driver is not disposed in the related art, as many as possible. That is, in the straight gate block, the first scan driving circuit can be disposed at the outermost periphery. The emission driving circuit EM(n−2), the switching driving circuit SW(n−2), the reset driving circuit DVini(n−2), and the first scan driving circuit SP(n−2) are disposed above the second scan driving circuit SN(n−2) to ensure an empty space at the side of the second scan driving circuit SN(n−2) in the rounded corner area.

Next, in the gate driver 110 corresponding to the n−1-th pixel row P(n−1), the second scan driving circuit SN(n−1), the emission driving circuit EM(n−1), and the switch driving circuit SW(n−1) are disposed in the order closer to the pixel row P(n−1). In the situation of the gate driver corresponding to the n−1-th pixel row P(n−1), the reset driving circuit DVini(n−1) is disposed above the switching driving circuit SW(n−1) and the first scan driving circuit SP(n−1) is disposed at the side of the switching driving circuit SW(n−1) or the reset driving circuit DVini(n−1). Accordingly, the side of the reset driving circuit DVini(n−1) can be an empty space. The reset driving circuit DVini(n−1) corresponding to the n−1-th pixel row P(n−1) can be disposed at the side of the second scan driving circuit SN(n−2) corresponding to the n−2-th pixel row P(n−2) and on a lower surface of the reset driving circuit DVini(n−2) corresponding to the n−2-th pixel row P(n−2). By changing positions of the emission driving circuit EM(n−2), the switching driving circuit SW(n−2), the reset driving circuit DVini(n−2), and the first scan driving circuit SP(n−2) corresponding to the n−2-th pixel row P(n−2), an adequate amount of space for disposing the reset driving circuit DVini(n−1) corresponding to the n−1-th pixel row P(n−1) is prepared.

Referring to FIG. 7, in the gate driver 110 corresponding to the n-th pixel row P(n), the second scan driving circuit SN(n), the emission driving circuit EM(n), and the reset driving circuit DVini(n) are disposed in the order closer to the pixel row P(n). In the situation of a gate driver corresponding to the n-th pixel row P(n), the first scan driving circuit SP(n) can be disposed above the reset driving circuit DVini(n) and thus, the side of the reset driving circuit DVini(n) can be an empty space. That is, in the atypical gate block, the reset driving circuit can be disposed at the outermost periphery. The first scan driving circuit SP(n) corresponding to the n-th pixel row P(n) can be disposed at the side of the emission driving circuit EM(n−1) and the switching driving circuit SW(n−1) corresponding to the n−1-th pixel row P(n−1). By moving positions of the first scan driving circuit SP(n−1) and the reset driving circuit DVini(n−1) corresponding to the n−1-th pixel row P(n−1), an adequate space for disposing the first scan driving circuit SP(n) corresponding to the n-th pixel row P(n) is prepared.

In the gate driver 110 corresponding to the n+1-th pixel row P(n+1), as the same as the placement of FIG. 2, the second scan driving circuit SN, the emission driving circuit EM, the switch driving circuit SW, the reset driving circuit DVini, and the first scan driving circuit SP are disposed in the order closer to each pixel row.

Referring to FIG. 7, the positions of the emission driving circuit EM(n−2), the switching driving circuit SW(n−2), the first scan driving circuit SP(n−2), and the reset driving circuit DVini(n−2) corresponding to the n−2-th pixel row P(n−2) are moved. Further, the positions of the reset driving circuit DVini(n−1) and the first scan driving circuit SP(n−1) corresponding to the n−1-th pixel row P(n−1) are moved. Therefore, an empty space can be ensured at the corners of the display panel 100 corresponding to the n−2-th pixel row P(n−2), the n−1-th pixel row P(n−1), and the n-th pixel row P(n). The low potential power line 510 can be disposed in the ensured empty space with a shortest distance away from the display area which does not overlap the gate driver 110.

A length of the gate block corresponding to the n−2-th pixel row P(n−2) can be approximately half a length of a gate block of the n+1-th pixel row P(n+1). The length of the gate block can be considered as a length extending from an outer periphery of the pixel area 120 to an outer periphery of the non-display area.

Referring to FIG. 7, the low potential power line 510 extends in a horizontal direction and then turns in the vicinity of the first scan driving circuit SP(n−2) corresponding to the n−2-th pixel row P(n−2) to extend to form a diagonal line closest to the gate drivers 110. The low potential power line 510 extends at a corner area of the display panel 100 in a diagonal direction to extend to a right lower corner of the display panel 100 in the vicinity of the first scan driving circuit SP(n+1) corresponding to the n+1-th pixel row P(n+1) in the vertical direction.

The display apparatus according to the example embodiment of the present disclosure includes a liquid crystal display device (LCD), a field emission display device (FED), an organic light emitting display device (OLED), and a quantum dot display device.

Further, the display apparatus according to the example embodiment of the present disclosure can also include a set electronic device or a set device (or a set apparatus), which is a complete product or a final product including an LCM, an OLED module, or a QD module, such as a notebook computer, a television, or a computer monitor, an automotive display or equipment display including another type of vehicle, or a mobile electronic device including a smart phone or an electronic pad.

The features, structures, effects and the like described in the foregoing examples of the present application are included in at least one example of the present application and are not necessarily limited to one example. Moreover, the features, structures, effects and the like illustrated in at least one example of the present application can be combined or modified by those skilled in the art for the other examples to be carried out. Therefore, the combination and the modification of the present invention are interpreted to be included within the scope of the present application.

The foregoing present application is not limited to the foregoing examples and the accompanying drawings. It will be apparent to those skilled in the art that various modifications and changes can be made without departing from the scope and spirit of the present application. The scope of the present application is represented by the claims to be described below rather than the detailed description, and it is to be interpreted that the meaning and scope of the claims and all the changes or modified forms derived from the equivalents thereof come within the scope of the present application.

The example embodiments of the present disclosure can also be described as follows below.

According to an aspect of the present disclosure, there is provided a display apparatus. The display apparatus comprises a display area which is formed of pixel rows and has an outer periphery with a curved section and a straight section, a non-display area which encloses the display area and has an outer periphery with a curved section and a straight section, a gate driver which is configured by gate blocks corresponding to the pixel rows and is disposed in the non-display area, and a low potential power line which is disposed between the gate driver and the outer periphery of the non-display area. The gate block includes a plurality of stages.

The low potential power line and the gate driver do not overlap each other.

Gate blocks corresponding to the straight section of the outer periphery of the display area can be disposed in a straight line, and gate blocks corresponding to the curved section of the outer periphery of the display area can be atypical.

The plurality of stages can include a first scan driving circuit, a second scan driving circuit, an emission driving circuit, and a reset driving circuit.

The plurality of stages can further include a switching driving circuit.

The straight gate block can have a first length extending from an outer periphery of the straight section of the display area to the outer periphery of the non-display area and the atypical gate block can have a second length extending from an outer periphery of the curved section of the display area to the outer periphery of the non-display area.

The first length can be larger than the second length.

According to another aspect of the present disclosure, there is provided a display apparatus. The display apparatus comprises a display area which is formed of pixel rows and has an outer periphery with a curved section and a straight section, a non-display area which encloses the display area and has an outer periphery with a curved section and a straight section, and a gate driver which is configured by gate blocks corresponding to the pixel rows and is disposed in the non-display area. The gate block includes a plurality of stages and the plurality of stages include a first scan driving circuit, a second scan driving circuit, an emission driving circuit, a switching driving circuit, and a reset driving circuit.

The display apparatus can further comprise a low potential power line which is disposed between the gate driver and the outer periphery of the non-display area. The low potential power line and the gate driver can do not overlap.

The gate blocks corresponding to the straight section of the outer periphery of the display area can be disposed in a straight line, and the gate blocks corresponding to the curved section of the outer periphery of the display area can be atypical.

In the atypical gate block, the reset driving circuit can be disposed at the outermost periphery.

In the straight gate block, the first scan driving circuit can be disposed at the outermost periphery.

The switching driving circuit can be disposed to be closer to the display area than the reset driving circuit.

The atypical gate block can include a n-th gate block and a n+1-th gate block and a first scan driving circuit of the n+1-th gate block can be disposed at a side of an emission driving circuit of the n-th gate block, where n is a natural number.

In the atypical gate block, the first scan driving circuit can be disposed above the reset driving circuit.

Although the example embodiments of the present disclosure have been described in detail with reference to the accompanying drawings, the present disclosure is not limited thereto and can be embodied in many different forms without departing from the technical concept of the present disclosure. Therefore, the example embodiments of the present disclosure are provided for illustrative purposes only but not intended to limit the technical concept of the present disclosure. The scope of the technical concept of the present disclosure is not limited thereto. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display apparatus, comprising:

a display area including pixel rows, the display area having an outer periphery including a curved section and a straight section;

a non-display area surrounding the display area, the non-display area having an outer periphery including a curved section and a straight section;

a gate driver disposed in the non-display area, the gate driver including gate blocks corresponding to the pixel rows; and a low potential power line disposed between the gate driver and the outer periphery of the non-display area, wherein each of the gate blocks includes a plurality of stages, wherein the pixel rows include a n−2-th pixel row, a n-th pixel row and a n+1-th pixel row, where n is a natural number greater than or equal to 2, and wherein the low potential power line extends in a horizontal direction and includes a bend in an area corresponding to the n−2-th pixel row to extend in a diagonal line around a portion of the gate driver.

2. The display apparatus according to claim 1, wherein the low potential power line does not overlap with the gate driver.

3. The display apparatus according to claim 1, wherein a first group of the gate blocks corresponding to the straight section of the outer periphery of the display area are disposed in a straight line, and a second group of the gate blocks corresponding to the curved section of the outer periphery of the display area are disposed in an atypical arrangement or a non-uniform arrangement.

4. The display apparatus according to claim 3, wherein the first group of the gate blocks corresponding to the straight section has a first length extending from an outer periphery of the straight section of the display area to the outer periphery of the non-display area, wherein the second group of the gate blocks corresponding to the curved section has a second length extending from an outer periphery of the curved section of the display area to the outer periphery of the non-display area, and wherein the first length is greater than the second length.

5. The display apparatus according to claim 3, wherein the second group of the gate blocks corresponding to the curved section are arranged in an "]" type of arrangement shape, an "⌊" type of arrangement shape, or an "⊢" type of arrangement shape.

6. The display apparatus according to claim 1, wherein the plurality of stages include a first scan driving circuit, a second scan driving circuit, an emission driving circuit, and a reset driving circuit.

7. The display apparatus according to claim 6, wherein the plurality of stages further include a switching driving circuit.

8. The display apparatus according to claim 1, wherein the low potential power line extends in a diagonal direction in an area between the curved portion of the outer periphery of the display area and the curved portion of the outer periphery of the non-display area.

9. The display apparatus according to claim 1, wherein the gate driver includes a first gate driver disposed at one side of the non-display area and a second gate driver disposed at another side of the non-display area.

10. The display apparatus according to claim 9, wherein the first gate driver and the second gate driver are configured to simultaneously output a gate signal to a same row of pixels.

11. The display apparatus according to claim 9, wherein the first gate driver and the second gate driver are configured to output gate signals to different rows of pixels at different timings.

12. A display apparatus, comprising:

a display area including pixel rows, the display area having an outer periphery including a curved section and a straight section;

a non-display area surrounding the display area, the non-display area having an outer periphery including a curved section and a straight section; and a gate driver disposed in the non-display area, the gate driver including gate blocks corresponding to the pixel rows, wherein each of the gate blocks includes a plurality of stages, wherein the plurality of stages include a first scan driving circuit, a second scan driving circuit, an emission driving circuit, a switching driving circuit, and a reset driving circuit, wherein a first group of the gate blocks corresponding to the straight section of the outer periphery of the display area are disposed in a straight line, and a second group of the gate blocks corresponding to the curved section of the outer periphery of the display area are disposed in an atypical arrangement or a non-uniform arrangement, and wherein the reset driving circuit in the second group of the gate blocks corresponding to the curved section is disposed at an outermost portion of the outer periphery of the non-display area.

13. The display apparatus according to claim 12, further comprising:

a low potential power line disposed between the gate driver and the outer periphery of the non-display area, wherein the low potential power line does not overlap with the gate driver.

14. The display apparatus according to claim 12, wherein the first scan driving circuit in the first group of the gate blocks corresponding to the straight section is disposed at an outermost portion of the outer periphery of the non-display area.

15. The display apparatus according to claim 12, wherein the switching driving circuit in the second group of the gate blocks corresponding to the curved section is disposed closer to the display area than the reset driving circuit in the second group of the gate blocks corresponding to the curved section.

16. The display apparatus according to claim 12, wherein the second group of the gate blocks corresponding to the curved section includes a n-th gate block and a n+1-th gate block, and a first scan driving circuit of the n+1-th gate block is disposed at a side of an emission driving circuit of the n-th gate block, where n is a natural number.

17. The display apparatus according to claim 12, wherein the second group of the gate blocks corresponding to the curved section are disposed in an "]" type of arrangement shape, an "[" type of arrangement shape, or an "⊢" type of arrangement shape.

18. The display apparatus according to claim 13, wherein the pixel rows include a n−2-th pixel row, a n-th pixel row and a n+1-th pixel row, where n is a natural number greater than or equal to 2, and wherein the low potential power line extends in a horizontal direction and has a bend in an area between the curved portion of the outer periphery of the display area and the curved portion of the outer periphery of the non-display area corresponding to the n−2-th pixel row to extend a diagonal line.

19. The display apparatus according to claim 18, wherein the low potential power line extends in a diagonal direction in an area between the curved portion of the outer periphery of the display area and the curved portion of the outer periphery of the non-display area to a lower curved section of the non-display area corresponding to the n+1-th pixel row in a vertical direction without overlapping with any portion of the gate driver.

20. A display apparatus, comprising:

a display area including pixel rows, the display area having an outer periphery including a curved section and a straight section;

a non-display area surrounding the display area, the non-display area having an outer periphery including a curved section and a straight section; and a gate driver disposed in the non-display area, the gate driver including gate blocks corresponding to the pixel rows, wherein each of the gate blocks includes a plurality of stages, wherein the plurality of stages include a first scan driving circuit, a second scan driving circuit, an emission driving circuit, a switching driving circuit, and a reset driving circuit, wherein a first group of the gate blocks corresponding to the straight section of the outer periphery of the display area are disposed in a straight line, and a second group of the gate blocks corresponding to the curved section of the outer periphery of the display area are disposed in an atypical arrangement or a non-uniform arrangement, and wherein the first scan driving circuit in the second group of the gate blocks corresponding to the curved section is disposed above the reset driving circuit in the second group of the gate blocks corresponding to the curved section.

* * * * *